US006412692B1

(12) United States Patent
Miyagawa

(10) Patent No.: US 6,412,692 B1
(45) Date of Patent: Jul. 2, 2002

(54) METHOD AND DEVICE FOR IDENTIFYING QUALIFIED VOTER

(75) Inventor: Takayoshi Miyagawa, Tokyo (JP)

(73) Assignee: The Center for Political Public Relations, Inc., Tokyo (JP)

( * ) Notice: Subject to any disclaimer, the term of this patent is extended or adjusted under 35 U.S.C. 154(b) by 0 days.

(21) Appl. No.: 09/445,208

(22) PCT Filed: Apr. 6, 1999

(86) PCT No.: PCT/JP99/01817

§ 371 (c)(1),
(2), (4) Date: Dec. 6, 1999

(87) PCT Pub. No.: WO99/52058

PCT Pub. Date: Oct. 14, 1999

(30) Foreign Application Priority Data

Apr. 6, 1998 (JP) ..... 10-093523

(51) Int. Cl.[7] ..... G06K 5/00
(52) U.S. Cl. ..... 235/382; 235/386; 235/380
(58) Field of Search ..... 235/382, 380, 235/386

(56) References Cited

U.S. PATENT DOCUMENTS 5,095,196 A 3/1992 Miyata
5,412,727 A * 5/1995 Drexler et al. ..... 235/386
5,497,318 A * 3/1996 Miyagawa et al. ..... 235/50 A
5,875,432 A * 2/1999 Sehr ..... 235/386

FOREIGN PATENT DOCUMENTS

| | | |
|---|---|---|
| JP | 3-62158 | 3/1991 |
| JP | 6-180708 | 6/1994 |
| JP | 6-251048 | 9/1994 |
| JP | 407282150 A * | 10/1995 |

* cited by examiner

*Primary Examiner*—Karl D. Frech
*Assistant Examiner*—Daniel Walsh
(74) *Attorney, Agent, or Firm*—Banner & Witcoff, Ltd.

(57) ABSTRACT

The present invention improves an efficiency of a reception job at a polling stations by introducing an automation of the job and prevents an illegal voting.

Information of voters name and other related data including a portrait photograph recorded on an entrance ticket to the polling station such as ID card is read by a reading apparatus 25. The data read out is compared with corresponding data in a voter's database formed in a memory apparatus 24 by a computer 21 thereby the voter is identified automatically. When the voter is identified, a voting card is issued from a voting paper issuing apparatus 26. The conventional jobs for referring to a voters list by receptionists and for handing a voting card to voters are not necessary because of the automation. Moreover, as the voting card is not issued for unauthentic voters, illegal voting can be prevented.

24 Claims, 14 Drawing Sheets

METHOD AND DEVICE FOR IDENTIFYING QUALIFIED VOTER

TECHNICAL FIELD

The present invention relates to an automation of a reception job at a polling station of elections, and especially to a method and apparatus for identifying a voter.

BACKGROUND ART

Conventionally, in elections of members of parliaments, governors of a metropolis, metropolitan prefectures and prefectures, assembly members of a metropolis and prefectures and mayors of cities, towns, and villages, a postcard is mailed to voters from local government that is used for a polling station ticket according to the law regulating election of public officials. A voter brings the postcard to a polling station and is identifyed to be an authentic voter with reference to a voters list. Receiving a voting paper, the voter writes a candidates name and casts a vote. When a plurality of election are performed at the same time, a plurality of voting papers are delivered on each of which a candidate name is written and are cast in different boxes. Ballot boxes are then brought to such a place as a gymnasium where ballot boxes are opened to count votes by human wave tactics and vote counting is then totaled.

In conventional voting described above, reception, voting and counting job are not automated and thus much time is spent in the vote counting. Especially in reception job in polling station, the following complicated job by man hand was necessary.

In the reception desk of polling station, voters hand the postcard to a staff. Based upon the address, name and other items of the voter on the postcard, the staff refers to the page of voters' list where the voters' names are listed, marks a check that the reception is over and handed a voting paper to the voter. In the past, many staff including a staff for reading the postcard, a staff for referring voters lists, and a staff for handing a voting paper performed such reception job.

It thus takes much time especially in referring voters list wherein the risk for staff's check mistake was high. Moreover, as the voters list is divided into a plurality of sublists and are checked by a plurality of staffs in a polling station with many voters, retention of staff members and personnel expenses were problems.

Relating to the automation of reception job, vote casting or vote counting, the research and development has been actively carried out centralizing to the electronic voting systems and many techniques have been disclosed by patents and technical papers. In the electronic voting systems, voter identification job for preventing double voting or voting by other person is necessary. With respect to the automation of such job, various systems have been suggested. For example, in the Japanese laid open patent application No.6-119519, a voting and vote counting system is disclosed in which a magnetic card is used for identifying voters. In the systems, a terminal for voting reads a personal magnetic card in which information identifying a voter is recorded and is used only when the record coincides with the record stored in a memory device. The voter is identifyed by a voter's portrait photograph attached to the magnetic card. Furthermore, personal computer checks the same voter not to double vote in the same election in the system.

The Japanese laid open patent application No.6-251049 also discloses a voting reception terminal in which a reader provided in a polling station to identify the voter reads a personal identification IC card owned by a voter. In the card, voter's portrait data, finger print data together with personal data such as voter's address, full name, date of birth, gender and age are recorded.

However, these conventional systems had drawbacks that reliability for identifying the voter is not adequate and the identification process is complicated. That is to say, in the voting system disclosed in the Japanese patent application No. 6-119519, since identification of the voter is performed by a magnetic card with a portrait attached owned by a voter, the portrait and data are easily amended and changed, so that reliability of identification of the voter is not sufficient. Further, the Japanese laid open patent application No. 6-119519 discloses a voting reception terminal apparatus in which an IC card owned by a voter records personal data including portrait data and characteristic data of finger prints. With the apparatus, however, printing process of a finger print from a voter at polling station is troublesome and it is difficult to get agreement of voters since the process may cause a question of touching upon the human rights. Since the portrait data of a voter is recorded in IC card owned by the voter, there is also a possibility that the data is changed.

The present invention has been made in consideration of the above situation.

It is an object of the present invention to provide a method and apparatus for identifying the authentic voter with an easy checking process at the polling station.

It is another object of the present invention to provide a method and apparatus for identifying the authentic voter with high reliability.

DETAILED DESCRIPTION OF THE INVENTION

Figure 1:
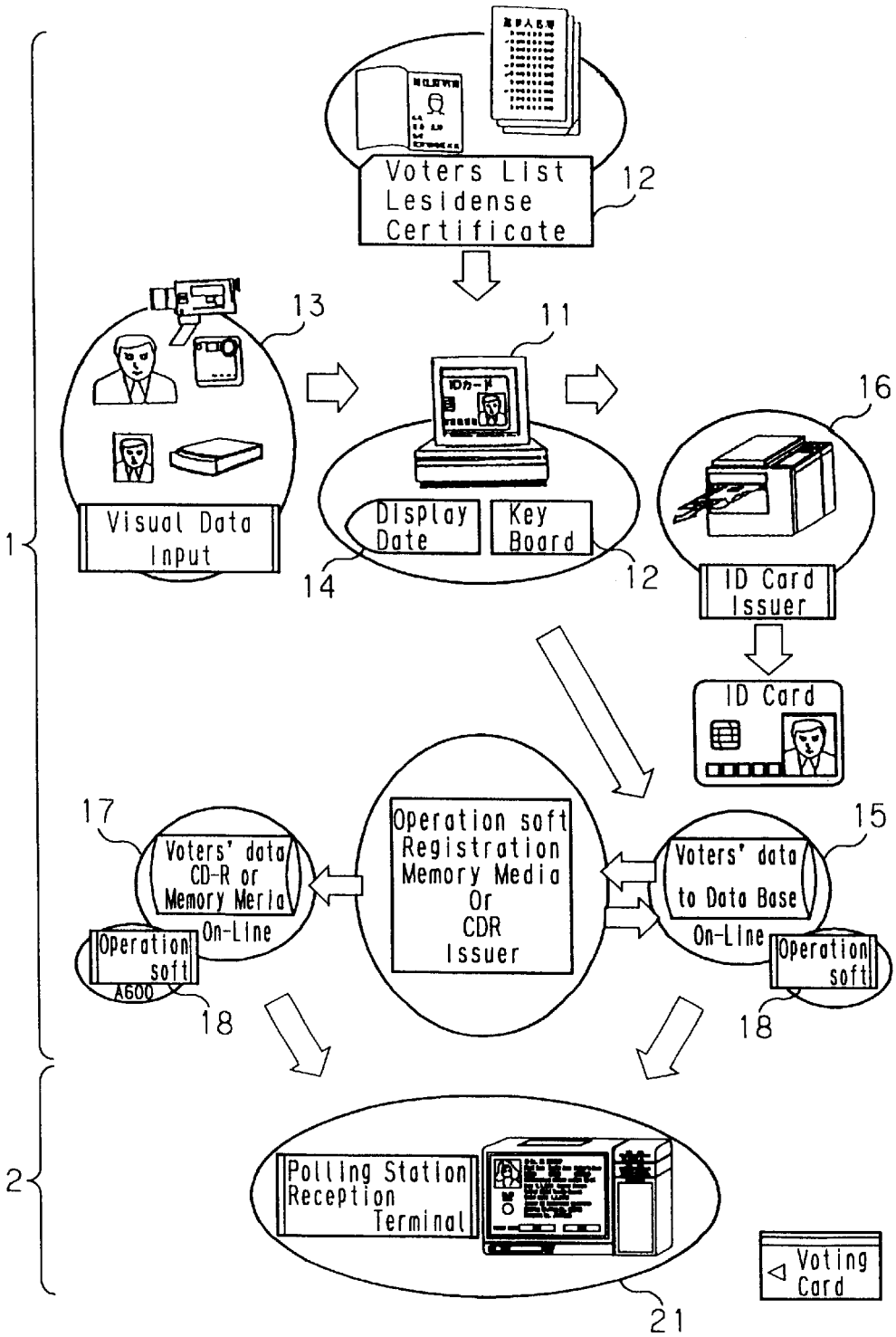
FIG. 1 is a diagram showing a total construction of an apparatus used for identifying a voter according to the present invention.

According to the method for identifying a voter, confirmation whether a voter is authentic or not is carried out in two steps. In a first step, a reception manager of a polling station compares a portrait photograph of the voter attached to an entrance ticket to the polling station owned by the voter with a face of the voter with his or her eyes. In a second step, portrait data of the voter stored in a voter identification apparatus is displayed on a touch panel display device and is compared again with the real face of the voter by the reception manager with his or her eyes.

In this way, the identification of an authentic voter is carried out by eyesight of the reception manager in two steps comparing the portrait of the voter and the real face of the voter. Since the identification of a voter by seeing the face and comparing it with the portrait is done while the reception manager sees the voter, it can easily be done in a short time with high reliability without using any complicated apparatus.

Since the voter identification apparatus according to the present invention performs checking operation using a touch panel display device with a simple input operation, an outside operator cannot know inside data and structure of the apparatus through outside operation of the device. The device is thus excellent in keeping information secret.

The more concrete features of the present invention are described below.

A method for identifying a voter according to the present invention comprises the steps of: storing personal data of voters including their portrait photograph data extracted from a voters list into a voters data base, recording at least a part of the personal data and the portrait photograph on an entrance ticket to a polling station and delivering it to each voter, reading the personal data recorded on the entrance ticket by a terminal device having a touch panel, comparing the personal data read out from said voters data base through on-line or off-line into the terminal device with the personal data read out from the entrance ticket, displaying the portrait data read out from the voters data base on the touch panel of the terminal device when both of the personal data are identical, confirming the authenticity by comparing the portrait photograph displayed on the touch panel with the face of the voter with man's eyes, and delivering a voting card to the voter based on the result of the confirmation of the authentic voter.

A method for identifying a voter according to the present invention comprises the steps of storing personal data of voters including portrait photograph data and voting history data in a given election in a voters data base, distributing to each voter an entrance ticket to a polling station on which at least a part of the personal data of the voter is recorded and on which a portrait photograph of the voter is printed, reading the personal data and voting history data of the voter recorded on the entrance ticket using a terminal device having a touch panel, displaying on the touch panel a fact that the voter is going to do double voting and stopping further processing when the voting history data read out showed the fact, comparing the personal data read out from said voters data base, based on the personal data read from the entrance ticket, through on-line or off-line into the terminal device with the personal data read out from the entrance ticket when the voting history data showed to be not a double voting, stopping the further processing when the both data are not identical, displaying the portrait data read out from the voters data base on the touch panel of the terminal device when both of the personal data are identical, confirming the authenticity by comparing the portrait photograph displayed on the touch panel with the face of the voter with man's eyes and by voting history data, inputting an information about the authenticity by a selective input means displayed on the touch panel, stopping further processing when the information shows that the voter is unauthentic, additionally recording the voting history of the given election in the entrance ticket and in the voter data base when the information shows that the voter is authentic, and delivering a voting card to the voter who is confirmed to be authentic.

In the method for identifying a voter according to the present invention, it is characterized in that formerly present voter's information including a full name is recorded in a code form in voters list and portrait photograph is recorded in picture form.

In the method for identifying a voter according to the present invention, it is characterized in that the result of the confirmation is transmitted through the touch panel display or through a voice.

An apparatus for identifying a voter according to the present invention comprises a voter data base for storing personal data including a portrait photograph data for plurality of voters, an entrance ticket to a polling station that is distributed to each of the voters on which the personal data except for the portrait photograph data is recorded and on which the portrait photograph is displayed, and a terminal device having a touch panel for reading the personal data of voters recorded on the entrance ticket. The terminal device further comprises a means for reading out the corresponding personal data from the voter data base to the personal data read out from the entrance ticket and for comparing the both personal data, a means for displaying the portrait photograph data on the touch panel together with the personal data read out from the voter's data base by the terminal device when the both personal data are identical, and a means for selectively inputting an information on the authenticity of a voter using an input means displayed on the touch panel.

An apparatus for identifying a voter according to the present invention comprises a voter database for storing personal data including a portrait photograph data and voting history data in a given election for plurality of voters, an entrance ticket to a polling station that is distributed to each of the voters on which the personal data except for the portrait photograph data is recorded and on which the portrait photograph is printed and displayed, and a terminal device having a touch panel for reading the personal data of voters recorded on the entrance ticket. The terminal device further comprises a means for displaying on the touch panel a fact that the voter is going to do double voting and stopping further processing when the voting history data read out showed the fact, a means for comparing the personal data read out from the voters data base according to the personal data read out from the entrance ticket, a means for displaying the portrait photograph data on the touch panel together with the personal data read out from the voter data base by the terminal device when the both personal data are identical, a means for confirming whether there is a voting history or not in the election based on the data included in the personal data recorded in the entrance ticket or the voter data base, a means for selectively inputting an information on the authenticity of the voter using an input means displayed on the touch panel when the authenticity of the voter is confirmed by the confirming means and the personal data including a portrait photograph data, a means for additionally recording the voting history in the given election in the entrance ticket and in the voter data base according to the information from the input means, and a means for delivering a voting card for the voter by the information from the input means.

In the apparatus for identifying a voter according to the present invention, it is characterized in that the entrance ticket is an IC card and the means for reading and recording is an IC card reader and writer for reading voters' name, birth date, gender, address recorded on the IC card and for writing an ID number of the terminal and a reception time.

In the apparatus for identifying a voter according to the present invention, it is characterized in that the means for reading and recording is includes optical character reading apparatus which optically reads letters indicating voters' name or voters ID number recorded on the entrance ticket.

In the apparatus for identifying a voter according to the present invention, it is characterized in that the means for reading and recording includes bar code reading apparatus for optically reading bar code indicating voters' name or voters' ID number recorded on the entrance ticket.

In the apparatus for identifying a voter according to the present invention, it is characterized in that the means for reading and recording includes magnetic reading apparatus for magnetically reading voters' name or voters ID number recorded magnetically on the entrance ticket.

In the apparatus for identifying a voter according to the present invention, it is characterized in that the comparing means comprises a means for finding voters' name which coincide with the result of reading of the entrance ticket by retrieving the voter data base, a means for reading the personal data corresponding to the voter' name found and a means for comparing the personal data thus read out with the personal data read out from the entrance ticket.

In the apparatus for identifying a voter according to the present invention, it is characterized in that the touch panel of the terminal device is a liquid crystal display device.

In the apparatus for identifying a voter according to the present invention, it is characterized in that the voting card is a voting paper on which the candidate's name is written.

In the apparatus for identifying a voter according to the present invention, it is characterized in that the voting card is a token for operating the voting terminal device into which the voter inputs data indicating the candidate's name.

In the apparatus for identifying a voter according to the present invention, it is characterized in that the result of the identification of the authentic voter is transmitted through the touch panel display or by a voice.

An apparatus for identifying a voter according to the present invention comprises a box type case, an inlet for inserting an entrance ticket to a polling station provided in front of the case, an outlet for delivering a voting card also provided in front of the case, a touch panel display device provided in front of the case, a card reading device stored inside the case for reading the personal data recorded on the entrance ticket inserted in the inlet and for recording additional data on the entrance ticket, a voter data memory for memorizing personal data including portrait photograph data for a plurality of voters, a display means provided in the case for comparing data read out from the card reading device with the corresponding personal data read out from the memory and for displaying the portrait photograph data together with the personal data on the touch panel device when both personal data are identical, an input means provided in the touch panel display device for inputting an information indicating that the voter is authentic when the voter is identified by comparing the picture displayed with the voter's face with men' eyes, a means stored in the case for delivering a voting card according to the information provided by the input means and for discharging the voting card for the voter who is confirmed to be authentic from the outlet.

An apparatus for identifying a voter according to the present invention comprises a box type case, an inlet for inserting an entrance ticket to a polling station provided in front of the case, an outlet for delivering a voting card also provided in front of the case, a touch panel display device provided in front of this case on which an information input button is displayed, a card reading and writing device stored in the case for reading the personal data recorded on the entrance ticket inserted in the inlet and for recording additional data on the entrance ticket, a voter data memory for memorizing personal data including portrait photograph data and a voting history in a given election for a plurality of voters, a means stored in the case for discharging the voting card for the voter who is identified from the outlet, and a central processing unit provided in the case. The central processing unit further comprises a means for comparing the data read out by the card reading and writing device with the corresponding personal data read out from said voter data base, a means for displaying the portrait photograph data on the touch panel together with the personal data read out from the voter data when the both personal data are identical, a means for confirming whether there is a voting history or not in the election based on the data included in the personal data recorded in the entrance ticket or the voter data base, a means for selectively inputting an information on the authenticity of the voter using an input means displayed on the touch panel when the voter is identified by the confirming means and the personal data including a portrait photograph data, a means for additionally recording the voting history in the given election in the entrance ticket and in the voter data base according to the information from the input means, and a means for operating the voting card discharging means and control it so as to discharge a voting card from the outlet for the voter who is identified.

In the apparatus for identifying a voter according to the present invention, it is characterized in that the voter data memory means is a memory that store temporally data transmitted from a voter data base connected by on-line or a memory that store data reproduced from the voter data base.

In the apparatus for identifying a voter according to the present invention, it is characterized in that the voting card delivering means further comprises a means for initializing the voting card before it discharges the voting card from the outlet.

In the apparatus for identifying a voter according to the present invention, it is characterized in that the voting card delivering means further comprises a means recording an unique number given to the apparatus for identifying a voter and a series number on the voting card when delivering the card.

In the apparatus for identifying a voter according to the present invention, it is characterized in that the voting card is composed of IC card.

In the apparatus for identifying a voter according to the present invention, it is characterized in that the case is provided with a card stacker in which voting cards are stacked, that the voting card stacked in the card stacker is taken out one by one according to the information on the authenticity and that prescribed data are written on the voting card which is then discharged from the outlet under the control of the central processing unit.

In the apparatus for identifying a voter according to the present invention, it is characterized in that the card stacker is made in a cartridge structure which is easy to insert and draw out of the case and that the cartridge is opened or closed by a key.

In the apparatus for identifying a voter according to the present invention, it is characterized in that the touch panel display device exhibits a picture explaining the flow of the issuing procedure of the voting card as a screen saver when the voter identification apparatus is not in use and that a series of guidance pictures including voice outputs corresponding to each step of issuing procedure of voting card are displayed when the voter identification apparatus is in use.

The embodiments according to the present invention are now explained in detail referring to the drawings attached.

Figure 14:
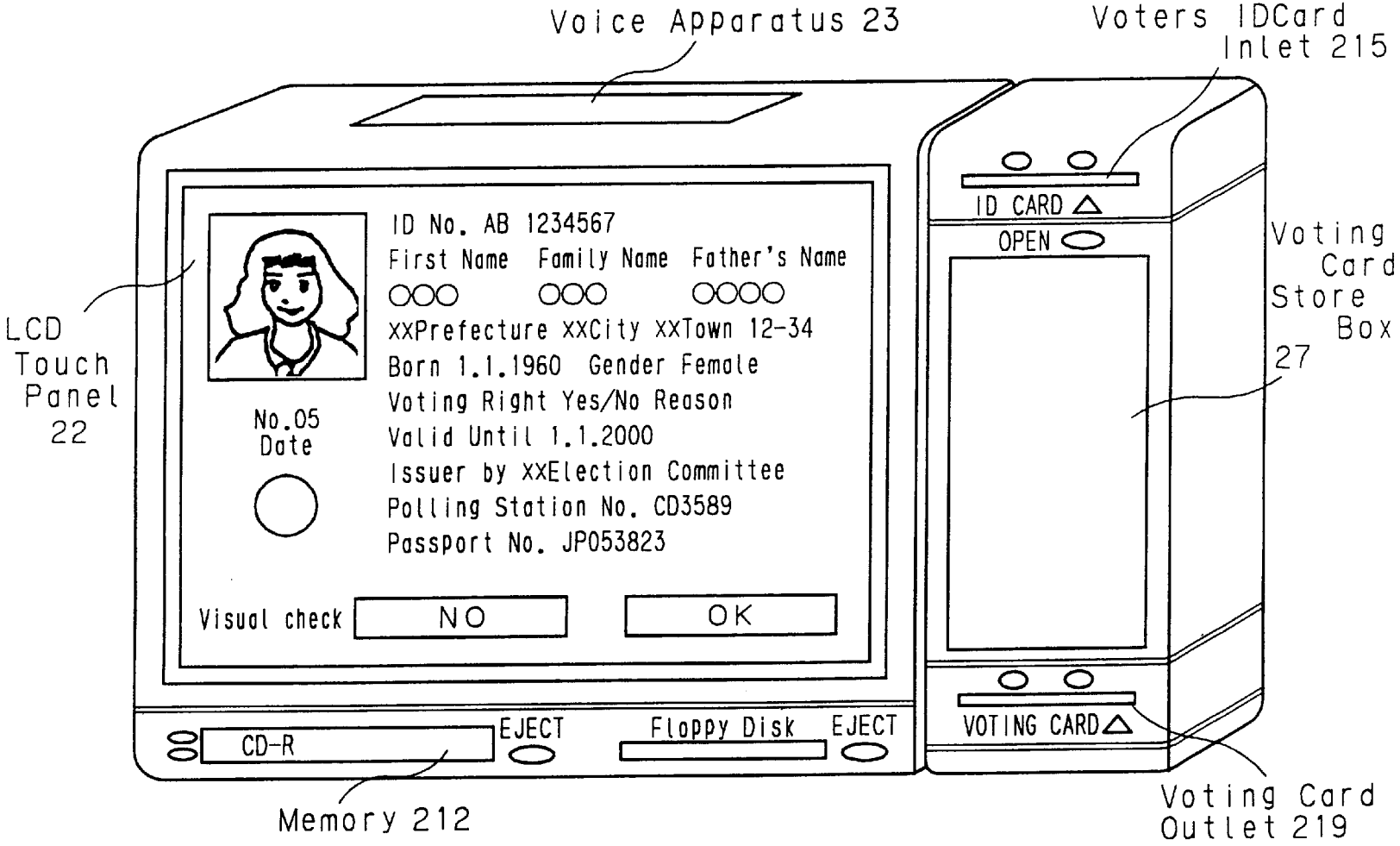
FIG. 14 is a view showing an outer configuration of the voter identification apparatus according to the present invention.

FIG. 1 is a diagram showing a whole system used for the method for identifying a voter according to the present invention. The system is divided into tow parts by functions one of which is ID card issuing system 1 and the other is voter identification system 2. A voter identification terminal 21, which is a center of voter identification system 2, is used as a reception terminal of a polling station. The appearance of the reception terminal is shown in FIG. 14. Voter identification terminal 21 is constructed so as to automatically perform a series of reception jobs at the polling station such as reading of an entrance ticket to the poling station, referring to a voters list or issuing of a voting card.

ID card issuing system 1 is provided for producing an ID card that is used for an ordinary entrance postcard to the polling station. The system produces personal database from information of voters such as voter list or residence certificates and issues it as the ID card. The ID card used in one embodiment of the present invention is made of one chip computer (CPU) containing a memory for reinforcing security function such as cipher. Here, the contents contained in the personal database are: (1) a portrait photograph of a voter, (2) an ID number, (3) a full name (a name of a father or a mother), (4) a polling station number, (5) a validity date, (6) a name of issuing organization, (7) a date of birth, (8) an address, (9) gender, (10) possession or not possession of voting right and the reason for it, (11) a passport number. Among these data, (1) to (6) is printed on ID card and (1) to (11) is recorded in IC of ID card as encode data.

ID card issuing system 1 is composed by a computer 11, a keyboard 12 for inputting the voter information, a digital camera or an image scanner 13 for producing a portrait photograph and inputting it into the computer, a display monitor 14 for displaying input and output data, a memory 15 for the voter's data base such as hard disk, CD-R etc. that stores the personal data and provide a data base for the reception terminal at the polling station, and ID card issuing apparatus 16 for issuing a ID card used as an entrance ticket to the polling station.

When the polling station is connected on-line with the database 15, the database is used as it is. When the polling station is off-line, the voter information is recorded on recording media 17 such as CD-R. The CD-R is then brought into the polling station. Voters are identified by the voter identification system 2 in a way described later. In memory media 15 and 17, operation software 18 described later is contained.

Figure 2:
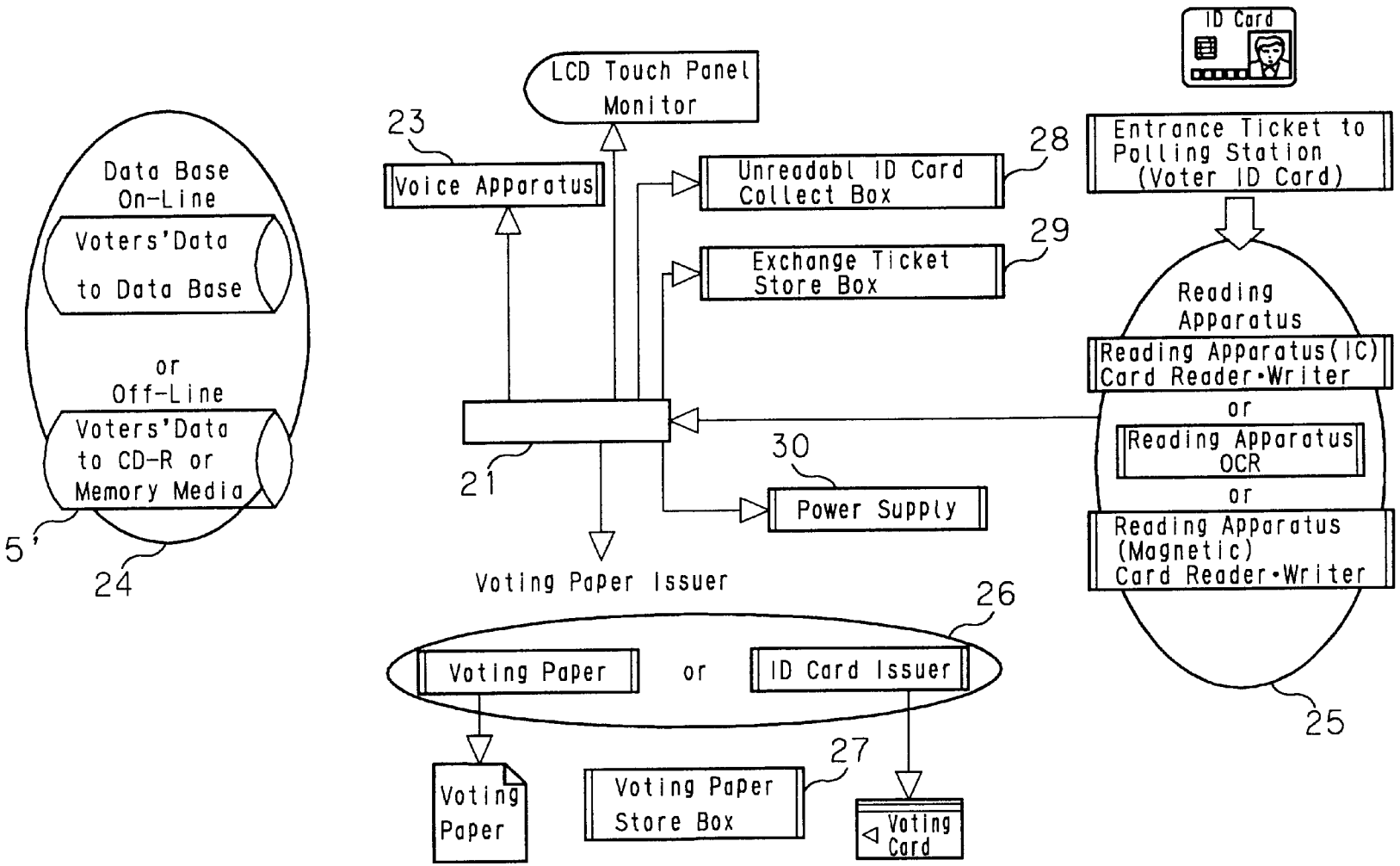
FIG. 2 is a diagram showing one embodiment of the voter identification apparatus shown in FIG. 1.

The voter identification system 2 is illustrated in FIG. 2. The system 2 replaces ordinary manual jobs such as referring to voters list and issuing of the voting card. Here, the voter identification terminal 21 contains a CD-R. An appearance of the terminal 21 is shown in FIG. 14. The main function of the voter identification terminal 21 1 is to install data from voter data base at each polling station using CD-R, to compare the data installed and data recorded in the ID card that is used for the entrance ticket to the polling station when it is inserted, to display the data installed only when the both data are identical and to urge a reception manager to identify the voter. The terminal 21 then issues a voting paper when the voter is confirmed to be authentic by men's eyes, records the voting history in the ID card and additionally records a personal voting record in such a internal recording media as a flash memory. At the time when the reception period for the election is over, voting record stored in the internal recording media is copied on the CD-R to send together with other CD-Rs to an the election administration committee.

To realize the function described, the voter identification system 2 is made up of a computer 21, a liquid crystal touch panel monitor 22, a voice apparatus 23 for outputting operation guidance by voice, a memory apparatus 24 such as a CD-R for storing voter data base, a reading apparatus 25 for reading voter information from ID card which is used as an entrance ticket to the polling station, and an issuing apparatus 26 for issuing a voting paper.

Liquid crystal touch panel monitor 22 displays the voter information including a portrait photograph and inputs the result of confirmation by men' eyes through an input button. Memory apparatus 24 records voting records in addition to the personal data in the voter database to avoid double voting. Here, a paper or a magnetic card may be used as a voting paper.

Although a keyboard is used for checking data displayed or for inputting data, in general, the touch panel monitor 22 is used in the embodiment of the present invention. The reason for using the touch panel monitor 22 is to reinforce security function. That is to say, when keyboard is used, a man who knows well about the system can look into the detail of the program and sometimes can change the program by operating the keyboard. On the other hand, when touch panel 22 is used, only a programmed process prepared in advance can operate the system. The program, therefore, can neither be changed nor be known to the man of the detail of the program. The touch panel 22 according to the embodiment of the present invention sets a limit to its operation by software and thus can increase security. With the touch panel 22, ordinary voters who are not accustomed to the machine operation can easily operate it to identify the authentic voter.

Since the voting history (a record of reception in the election) is written in an IC if it is built in the ID card, a card reader and writer is used which has a writing function besides a simple reading function. If data is written in the ID card by a bar code or a letter, bar code reader or a optical recognition apparatus such as OCR is prepared by an option for reading the data. If letters are written by magnetic stripe, magnetic card reader is prepared by an option.

The voter identification terminal 21 contains a collecting box 28 for unreadable ID cards and a storage box 29 for storing exchange tickets for reissuing unreadable ID card as well as a box 27 for voting papers. These boxes are of cartridge type which are easy to insert or draw out of the system and are locked. As a power supply 30, an uninterruptible power supply (UPS) or battery is provided which is capable of supplying power continuously to every parts of system when power supply from a power source is cut off.

Although an example is shown where stand-alone type terminal is used as the voter identification system 2 in the above embodiment, the invention is not limited to the embodiment. According to the size of polling station, different systems may be used. For example, a system may be used where a plurality of voter identification terminals are provided and a file server provided for the administration committee is accessed through a LAN (Local Area Network). Another system may be used where a voter identification terminal containing a large capacity file that is provided in a polling station for acting as a master is commonly used by a plurality of voter identification terminals acting as slaves.

Figure 3:
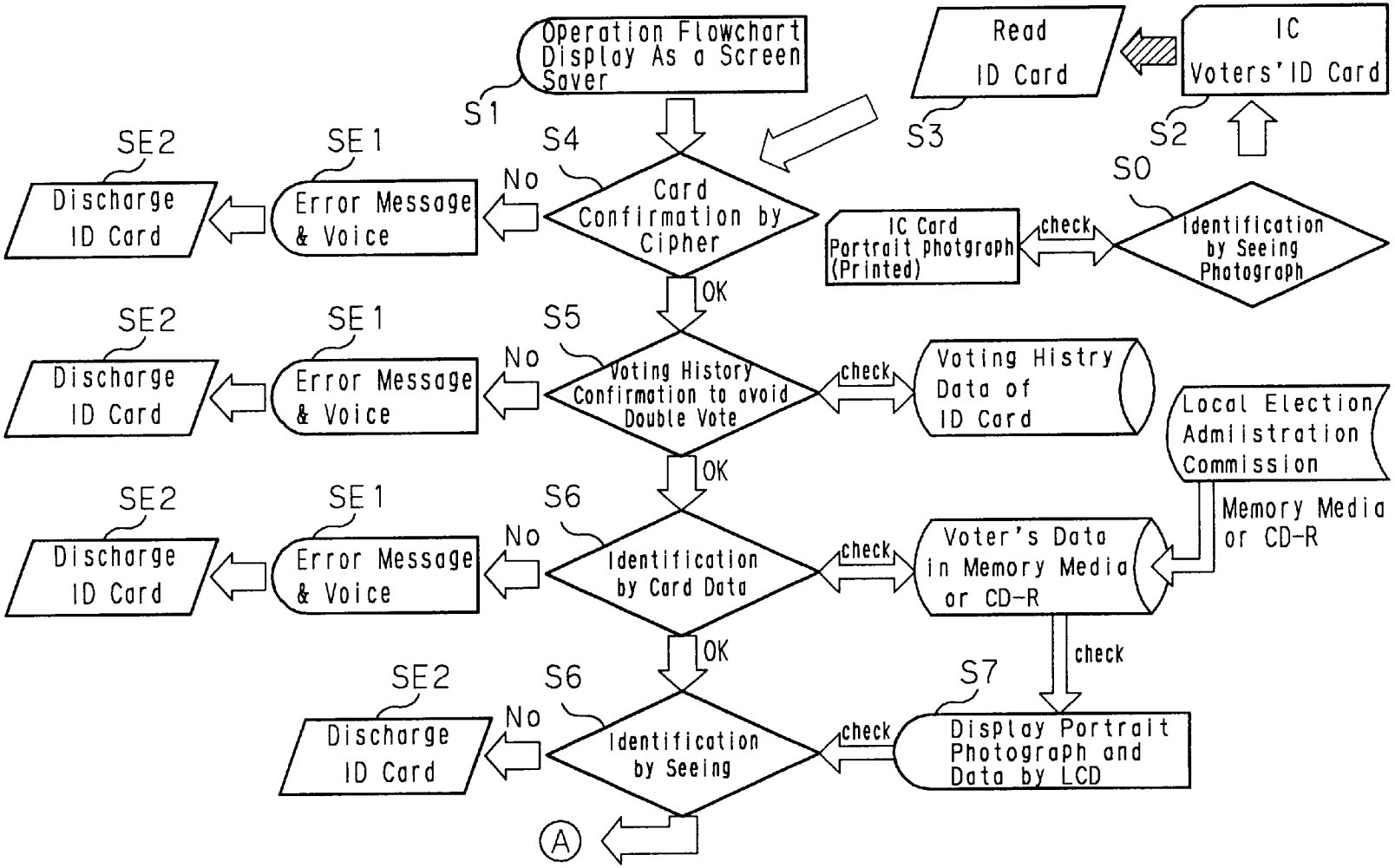
FIG. 3 is a flowchart showing a basic operation procedure (1) of the voter identification apparatus in FIG. 1.
Figure 4:
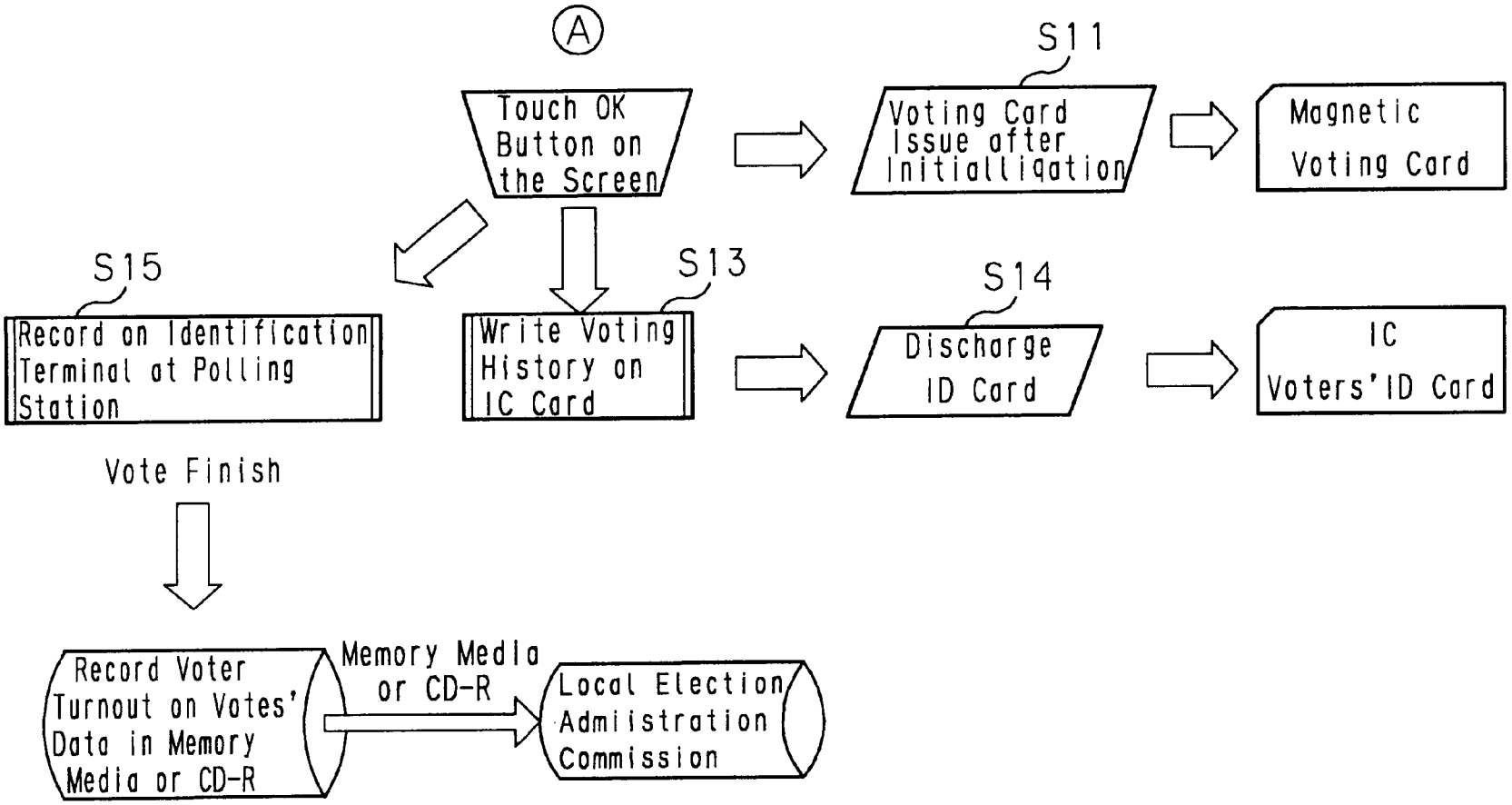
FIG. 4 is a flowchart showing a basic operation procedure (2) of the voter identification apparatus in FIG. 1.

FIG. 3 and FIG. 4 are flowcharts showing a process of reception job. A reception manager receives an ID card from a voter visited to a polling station and confirms the voter by comparing a portrait photograph on the ID card with a face of the voter with his or her eyes (step S0). An operation flow is displayed for the reception manager on the touch panel liquid crystal monitor 22 of the voter identification terminal 21 as a screen saver (step S1). The reception manager, after the visual check of the portrait photograph, inserts the ID card received from the voter visited into the reading apparatus 25. Then, the computer 21 reads voters information recorded on the ID card (step S2, S3). The computer 21 further confirms the authenticity of the card by cipher decoding, checks the reception record of the same election that is a inspection of a voting history for avoiding a double voting (step S5) and confirms the voter whether the voter is authentic or not referring to the personal data recorded on the card. A voice apparatus 23 announces an error massage if any one of these confirmations or check were negative (Step SE1, SE2). If these confirmations or check were all passed, the reception manager is urged to compare the photograph image displayed on the touch panel monitor 22 with the face of the voter (step S8).

Referring to the content of flag area in which the reception in the same election is recorded in the ID card, the voting history is inspected in step S5. The identification of a voter by card data in step S6 is done by comparing the card data with voters information stored in a voter's data base provided in the local election administration committee or stored as a copy of the voter's data base in such a memory media as a CD-R 24 installed in the terminal. When the voter is identified as a result of the comparison, the portrait photograph is displayed on the touch panel monitor 22 so that the reception manager is urged to do a visual check. The result of the visual check is confirmed by touching a button displayed on the touch panel monitor 22 (step S10 of FIG. 4). A voting card made of a magnetic card is initialized and is issued (step S11) by the issuing apparatus 27 of the voting paper.

Thereafter, the reception is recorded on the flag area of the ID card (step S13) and the ID card is then discharged (step S14). At the same time, the voting history is recorded in addition to the voter's information in the memory media or the CD-R to avoid double voting (step S15). The memory media or CD-R is sent to the local election administration committee at the proper time.

The applicant has already proposed an automation of voting and filed a patent application entitled as "Electronic voting system including election terminal apparatus" with Japanese Patent Office on Jul. 6, 1992, which was laid open as H6-28382 and was patented as No.2747171. The specification of the patent discloses as follows: "in an election terminal apparatus, voters elect a candidate by selecting or writing the candidate name using such a input means as a touch panel display on which the name of the candidate or a party is displayed. The voters make a final decision in selecting of the candidate by looking a display such as a photograph image of the candidate to be elected. The specification also discloses "voting terminals are connected to a host computer through a wire of radio network, so that the vote data from each terminal are totaled." Further details are not necessary here because the voting or totaling has no direct relation with the present invention.

Figure 5:
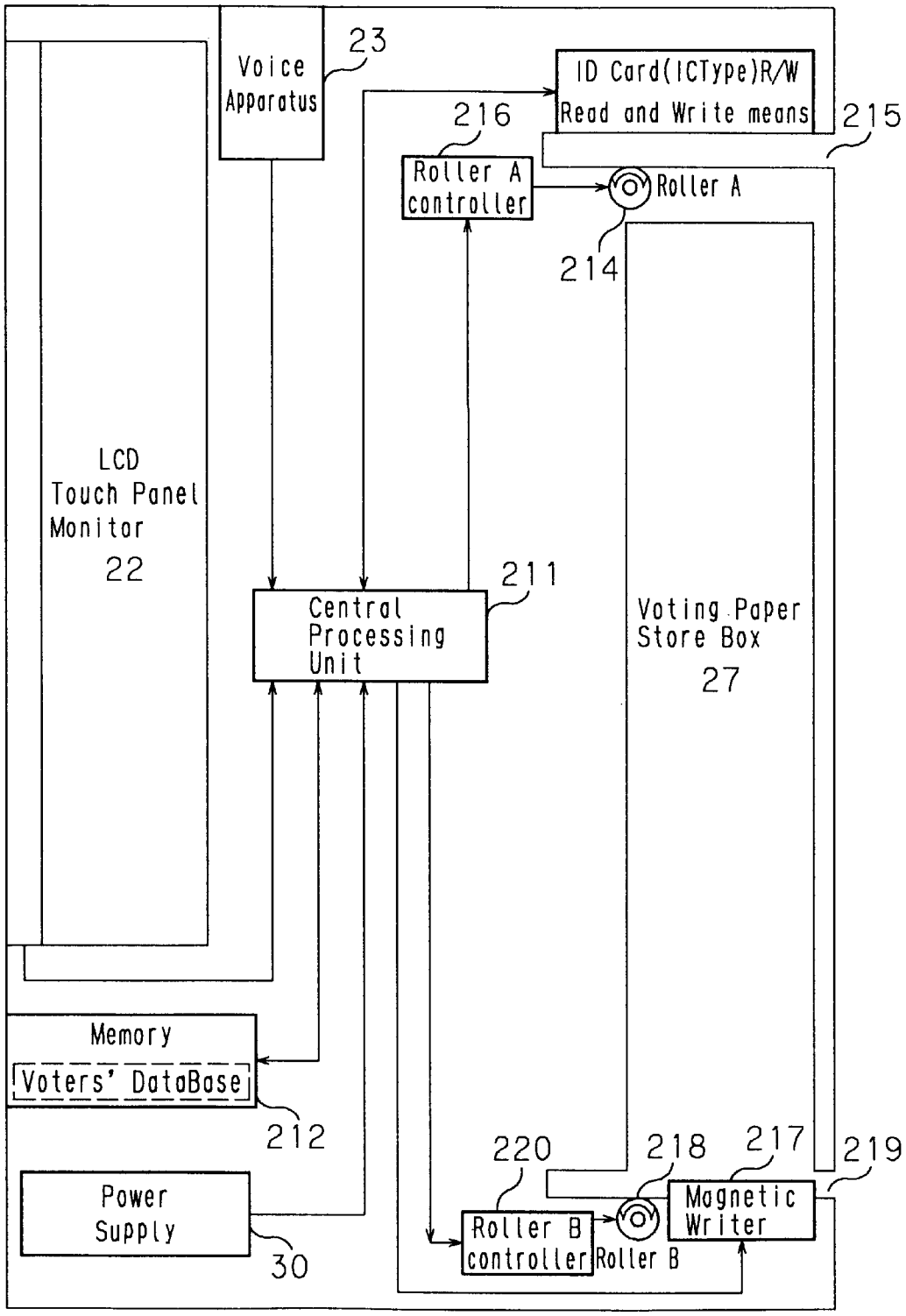
FIG. 5 is a block diagram showing internal structure of the voter identification apparatus of FIG. 1.
Figure 6:
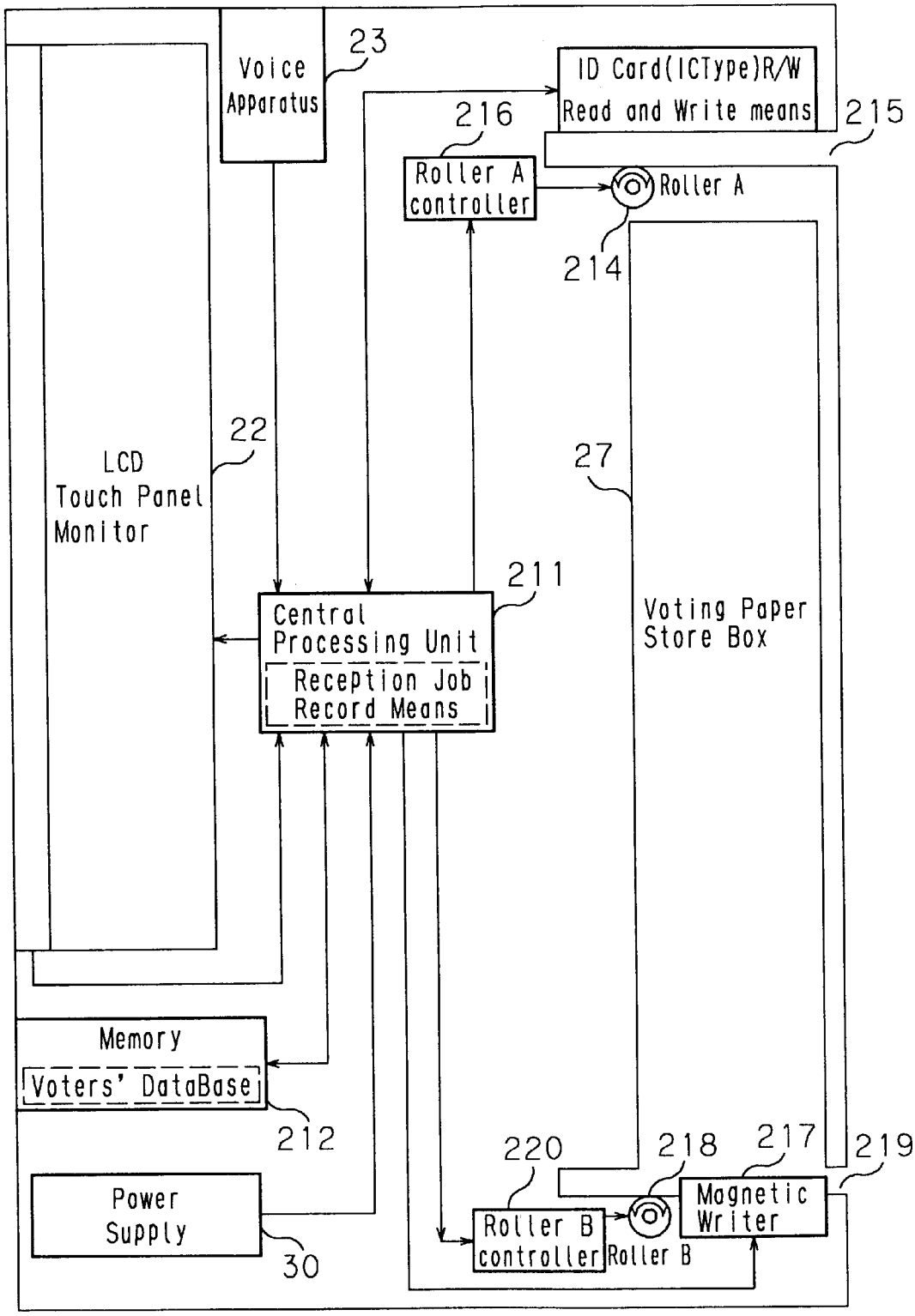
FIG. 6 is a block diagram showing another internal structure of the voter identification apparatus of FIG. 1.
Figure 7:
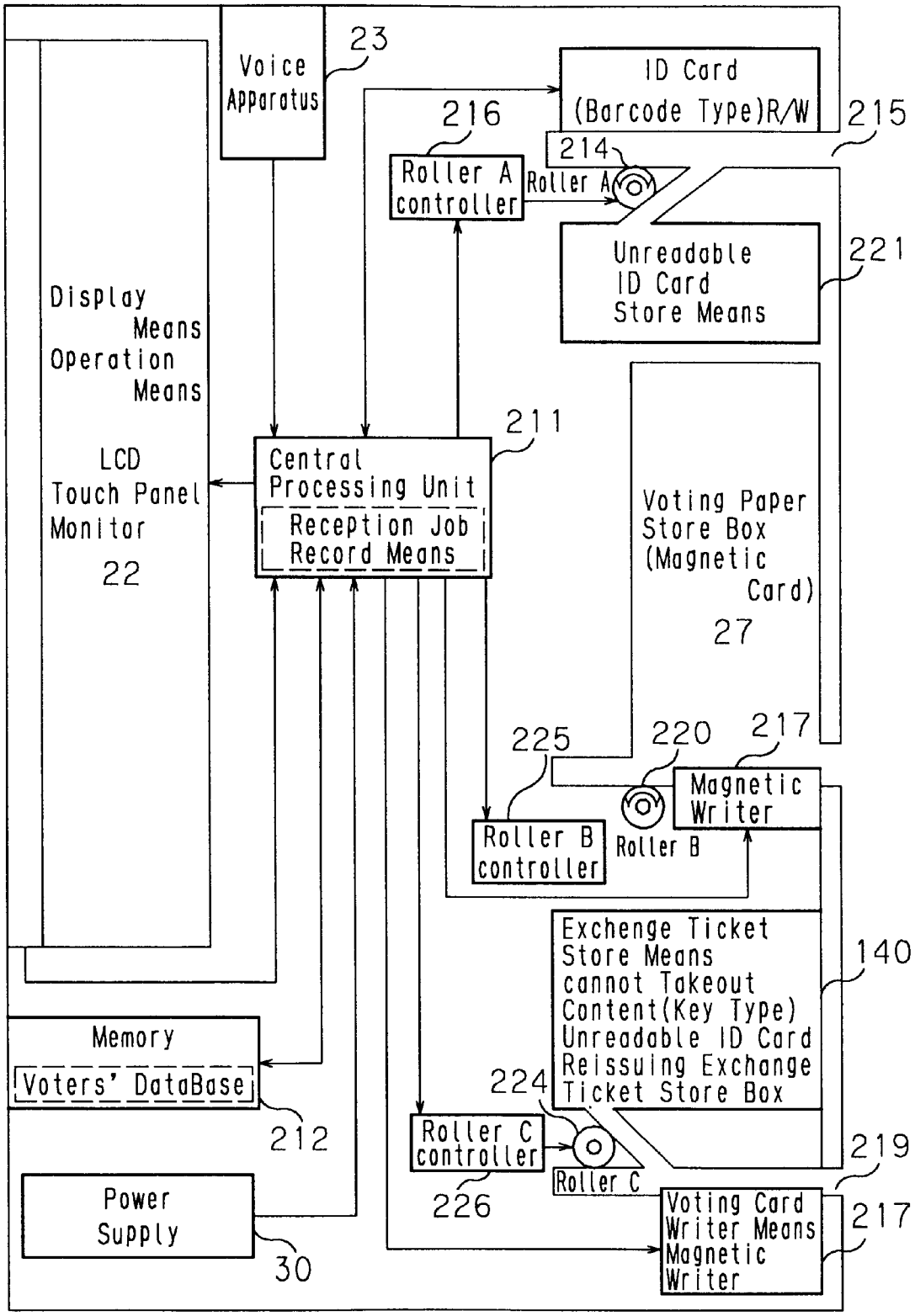
FIG. 7 is a diagram showing yet other internal structure of the voter identification apparatus
Figure 8:
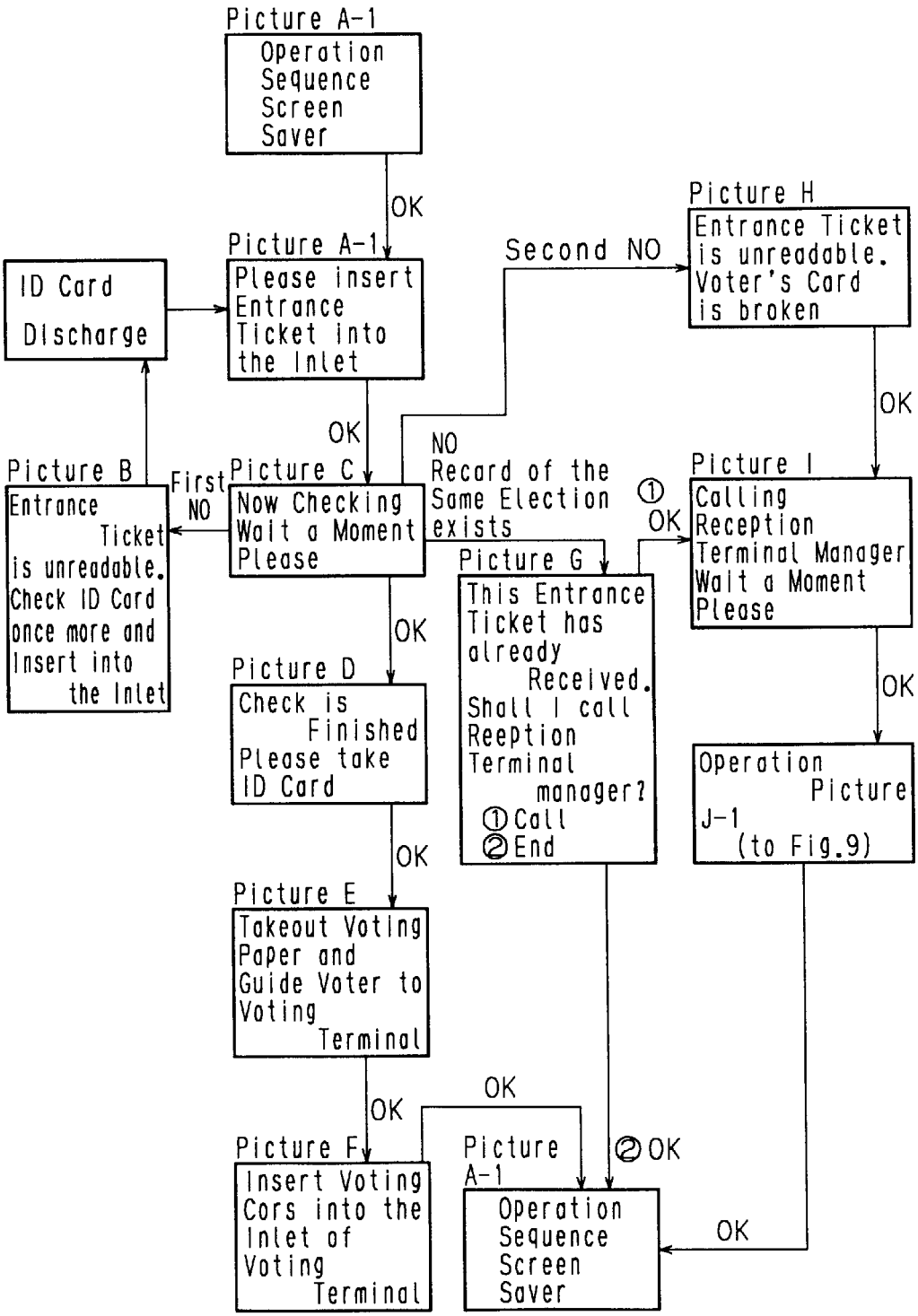
FIG. 8 is a diagram showing guidance screens used in implementation procedure 1 of the voter identification apparatus in FIG. 1.

FIG. 5 to FIG. 7 is a block diagram respectively showing an internal structure of the voter identification terminal 21. The terminal 21 shown in FIG. 5 is an off-line type terminal wherein an ID card is used as an entrance ticket to the polling station and wherein a voting paper is made of magnetic card. FIG. 6 is an on-line type terminal wherein an ID card recorded with bar code is used as an entrance ticket to the polling station and wherein a conventionally used voting paper is issued. The terminal 21 shown in FIG. 7 is an on-line type terminal wherein an ID card is used on which a bar code is recorded as an entrance ticket to a polling station and wherein a voting card made of a magnetic card is issued.

In FIG. 5 through FIG. 7, the same number as used in FIG. 2 indicates the same block as in FIG. 2. A central processing unit 211 is a main part of computer 21 shown in FIG. 2 and is composed of a CPU, a memory and peripheral circuits. Central processing unit 211 controls the other peripheral apparatuses installed in the case and performs voter identification operation under the control by operation software 18.

Memory 212 corresponds to the memory 23 shown in FIG. 2 and consists, for example, a hard disk or a CD-R. These media memorize various data and software in which voters information including portrait photograph are contained. As described above, the voters information is a voters list that is converted into a database for convenience of reference, which includes various personal data of voters (address, name, date of birth, etc.) and flag data for indicating whether voting is finished or not. The touch panel monitor 22 displays voter's data including portrait photograph and GUI (Graphic User Interface) for communicating with central processing unit 211.

An ID card reader writer 213 corresponds to the reading apparatus 25 shown in FIG. 2. It is provided for reading the voter's data from the ID card containing IC chip or from the ID card in which a data is recorded with bar code or a letter, or for writing in a flag information area a voting history which is a reception record of the same election. Roller 214 is used as a means for carrying the ID card inserted through an ID card inlet 215 which receive and discharge the ID card. A collection box 221 for unreadable ID cards may be provided as shown in FIG. 7. In this case, roller 214 does not discharge unreadable ID cards but transports them into entrance ticket collection box. A roller controller 216 under the control of the central processing unit 211 controls the roller 214.

A magnetic writer 217 corresponds to the voting paper issuer 26 in FIG. 2. The magnetic writer 217 is used for writing various data on the card depend on the necessity before the card is discharged. When a magnetic stripe card is used as a voting card, it is used at the same time for operating a voting terminal. With this configuration, the following treatment is for example possible. Magnetic stripe cards with no information recorded are stacked in a store box 27. At the time of issuing a voting card, the magnetic stripe card is made effective as a voting paper by recording such information meaning that it is effective as a voting paper by magnetic writer 217.

Roller 218 discharges voting cards stored in the store box 27 from the outlet 219 for delivering a voting card. The roller 218 is controlled by a roller controller 220, which receives a command from central processing unit 211. The store box 27 stacks voting cards and is a cartridge type box that is easy to insert into or draw out from the case. The store box 27 is locked inside so that only a special person can take out the contents.

In the embodiment shown in FIG. 7, papers instead of the magnetic stripe cards may be stacked in the store box 27 as for voting papers and a printer (not illustrated) may be provided instead of the magnetic writer 217 with which a necessary information is printed when delivering the voting paper. Of course, previously printed voting papers may be stacked and discharged directly.

As shown in FIG. 7, in order to relieve such accidents as a voter does not bring the ID card or the card is not recognized, an exchange ticket box 222 is provided. When the voter is identified to be authentic and the magnetic writer 223 records information that the voting is effective on the exchange ticket, the exchange ticket is discharged through the outlet 219. The exchange ticket box 222 is also of cartridge type and is usually locked. Roller 224 discharges the exchange ticket and is controlled by central processing unit 211 through a roller controller 226.

FIG. 8 to FIG. 11 illustrates a series of guidance display pictures, which are displayed on the touch panel monitor 22 of the voter identification terminal to explain about the operation to the reception manager of the polling station.

Figure 12:
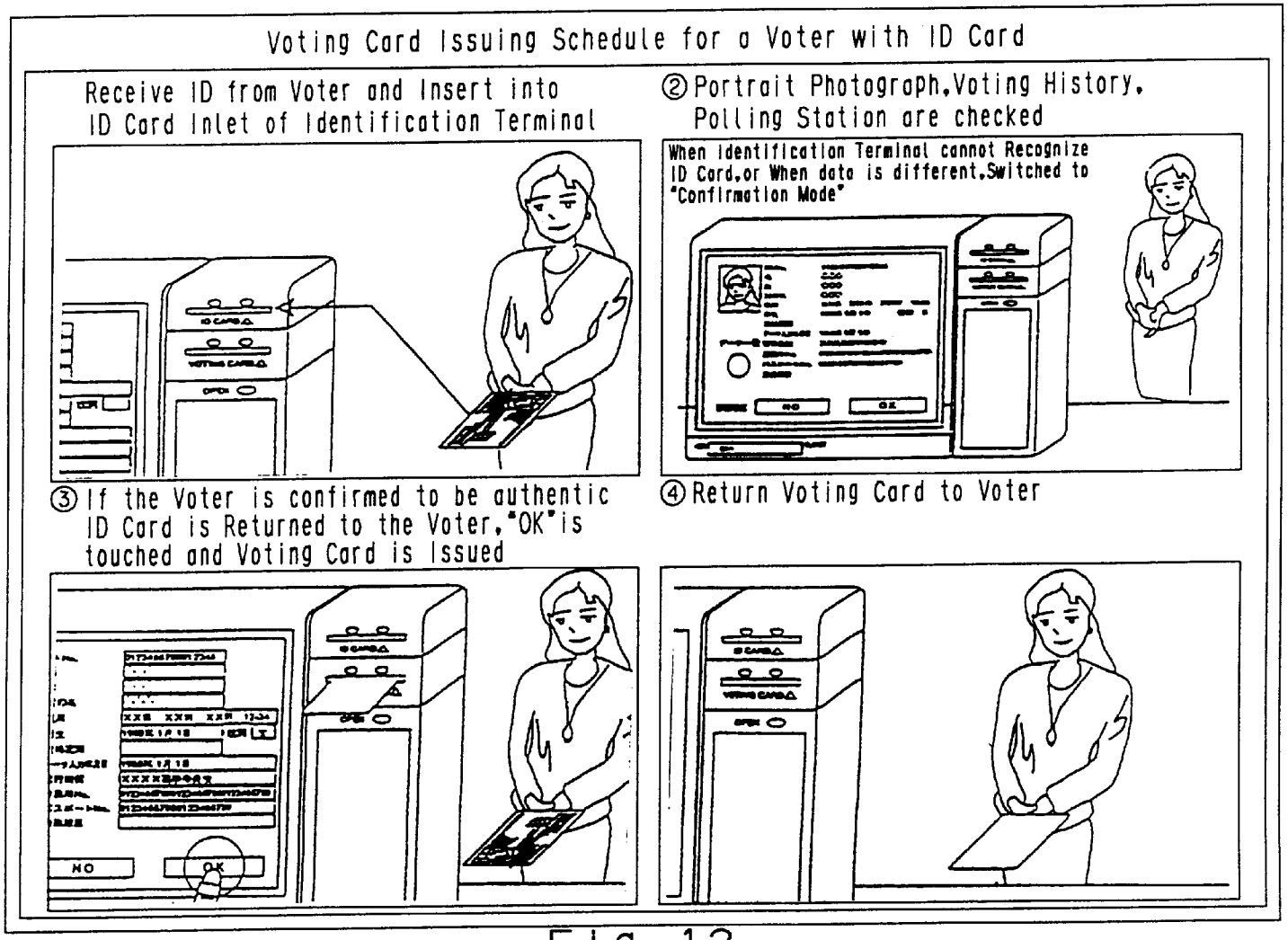
FIG. 12 is a screen saver displays showing a vote card issuing procedure for a voter having an ID card.
Figure 13:
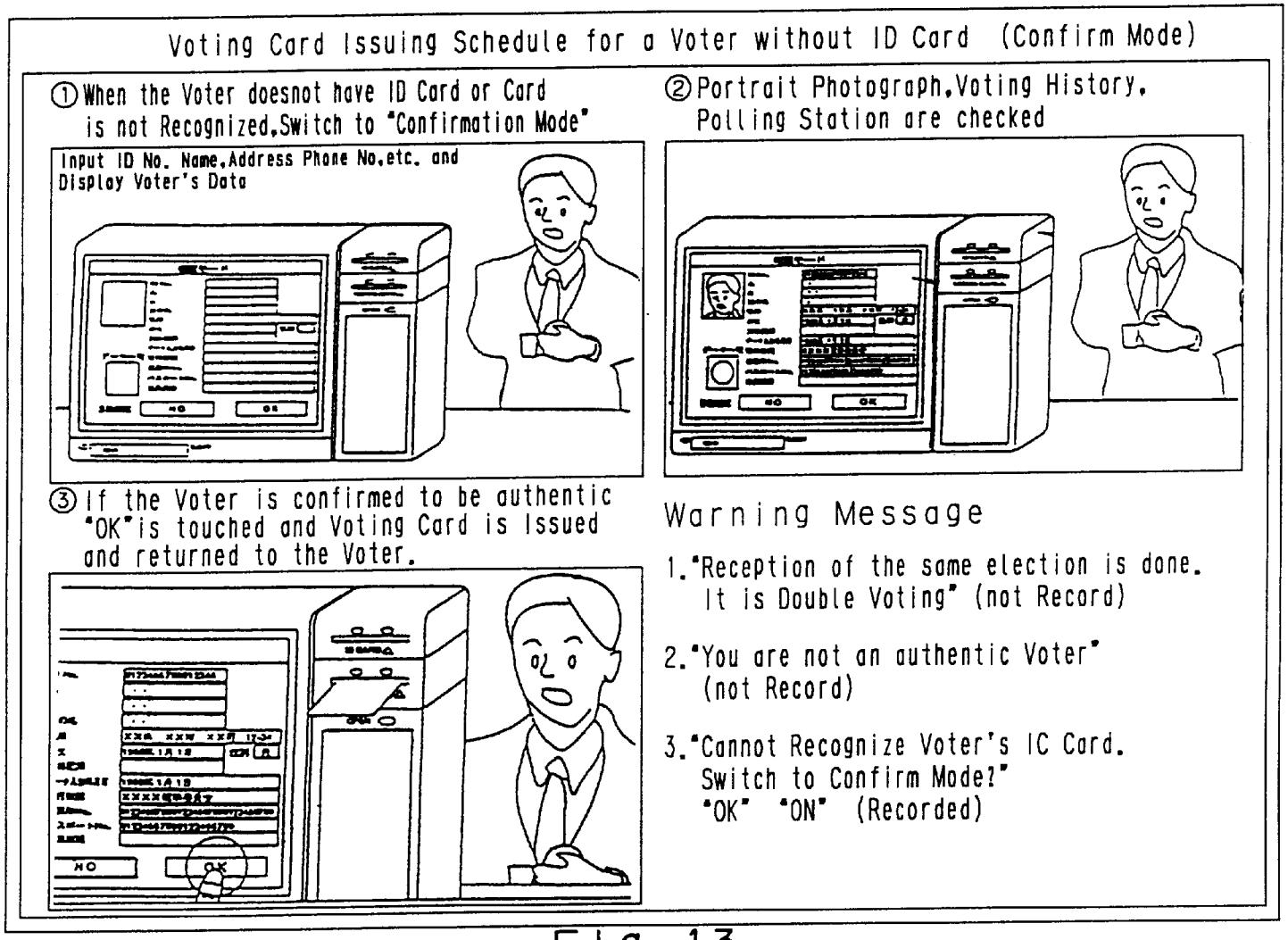
FIG. 13 is a screen saver displays showing a vote card issuing procedure for a voter having no ID card.

The operation of the embodiment of the present invention shown in FIG. 1 to FIG. 7 is explained in detail referring to FIG. 8 to FIG. 11. While the voter identification terminal 21 is not in use, the touch panel monitor 22 of the terminal 2 displays whole operation proceedings as a screen saver together with voice guidance. FIG. 12 and FIG. 13 illustrate the examples of display pictures. FIG. 12 shows a proceeding for issuing a voting paper for voters with ID cards and FIG. 13 shows that for voters without ID card. The latter is, in other word, a proceeding for issuing a voting paper based on the exchange ticket shown in FIG. 7.

When the voter identification terminal 21 starts its operation, the screen is changed; first, to a guidance picture (Picture A-1) displaying a message "please insert entrance ticket to the polling station into the inlet" with a voice announcement of the phrase. According to the guidance, the reception manager of the polling station receives an ID card from a voter, confirms the voter by comparing a voter's portrait photograph printed on the ID card with voter's face with eyes, and inserts the ID card into the inlet 215 of the voter identification terminal 21. Then, the touch panel monitor 22 displays a picture (Picture C) with a message "Now checking. Please wait for a moment." Here, computer 21 performs the checking step S4 through step S6 shown in FIG. 3. If something wrong is found, a message "Entrance ticket is unreadable. Check the ID card and insert it again into the inlet" is displayed (Picture B) with a guide of a voice. The ID card is then discharged from the outlet 215 and the former operation is repeated. If something wrong is found on the second time, the message "Entrance ticket is unreadable. Voter's ID card is broken" is displayed (Picture H) and, thereafter, the message "Calling a reception terminal manager. Please wait a moment." is displayed (Picture I). The following operation is illustrated in FIG. 9 and is described later.

If something wrong is detected by the check of step 5, the screen is changed to a message "This entrance ticket has already received. Is it necessary to call the terminal manager?" (Picture G) which urges the reception manager to selectively input information of calling the manager or of ending the further proceedings. If the ending of the further proceedings is selected, the screen is changed to the screen saver displaying the guidance pictures of the whole proceedings. If the calling of the reception terminal manager is selected, a message "Now calling an the reception terminal manager. Please wait for a moment" (Picture I) is displayed and moves to the steps shown in FIG. 9.

At the end of the confirmation of the step S4 to S6 and the visual check of the photograph in the step S8, a message "Check is finished. Please take ID card." (Picture D) is displayed and the voting paper is delivered by the voting paper issuer 26. The display on the touch panel monitor 22 is turned into a message "Take the voting paper and guide the voter to the voting terminal." (Picture E) and then to a message "Insert the voting card into the inlet of the voting terminal." (Picture F). Finally, the screen saver is displayed again.

Figure 9:
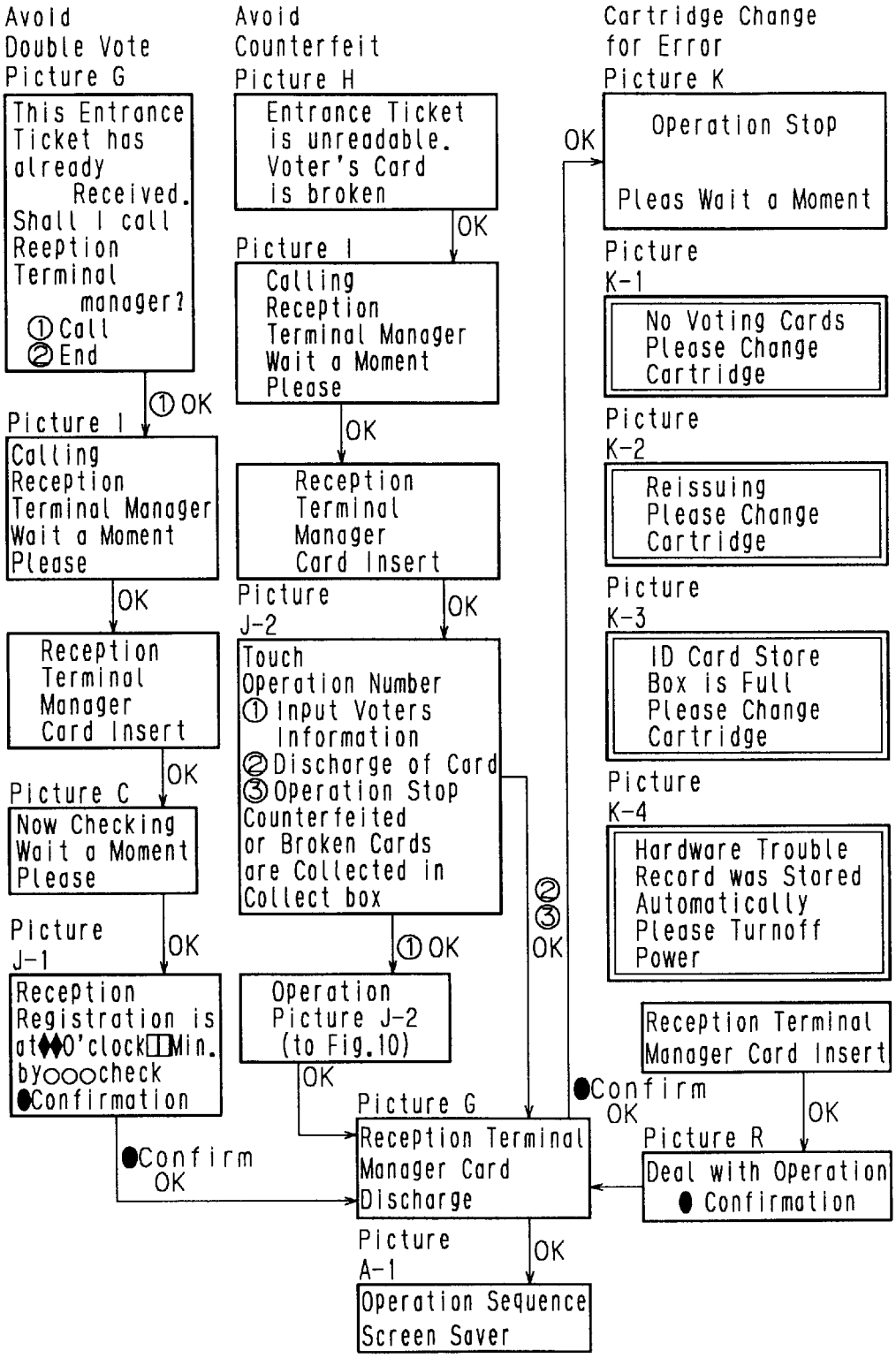
FIG. 9 is a diagram showing guidance screens used in implementation procedure 2 of the voter identification apparatus in FIG. 1.

Application of operation picture J-1 is explained by referring to FIG. 9. The guidance picture J-1 starts up a picture for an appropriate message depending on the circumstance, when the reception terminal manager inserts a manager's card into a insertion slit (not illustrated) of the voter identification terminal 21. As already described, the picture G starts for the checking of the double voting and picture H starts up for the checking in case there is a doubt of counterfeiting. In some situations, picture K is displayed for guiding a replace of the cartridge.

When the reception terminal manager inserts the manager's card after picture G turned into picture I, the guidance picture turns into a picture with a message "Now checking. Please wait a moment" (Picture C). Thereafter, the touch panel monitor 22 displays the time when the registration of the reception is finished (Picture J-1). Touching a check button on the touch panel monitor 22, the manager's card is discharged and the screen saver is displayed on the monitor 22.

Figure 10:
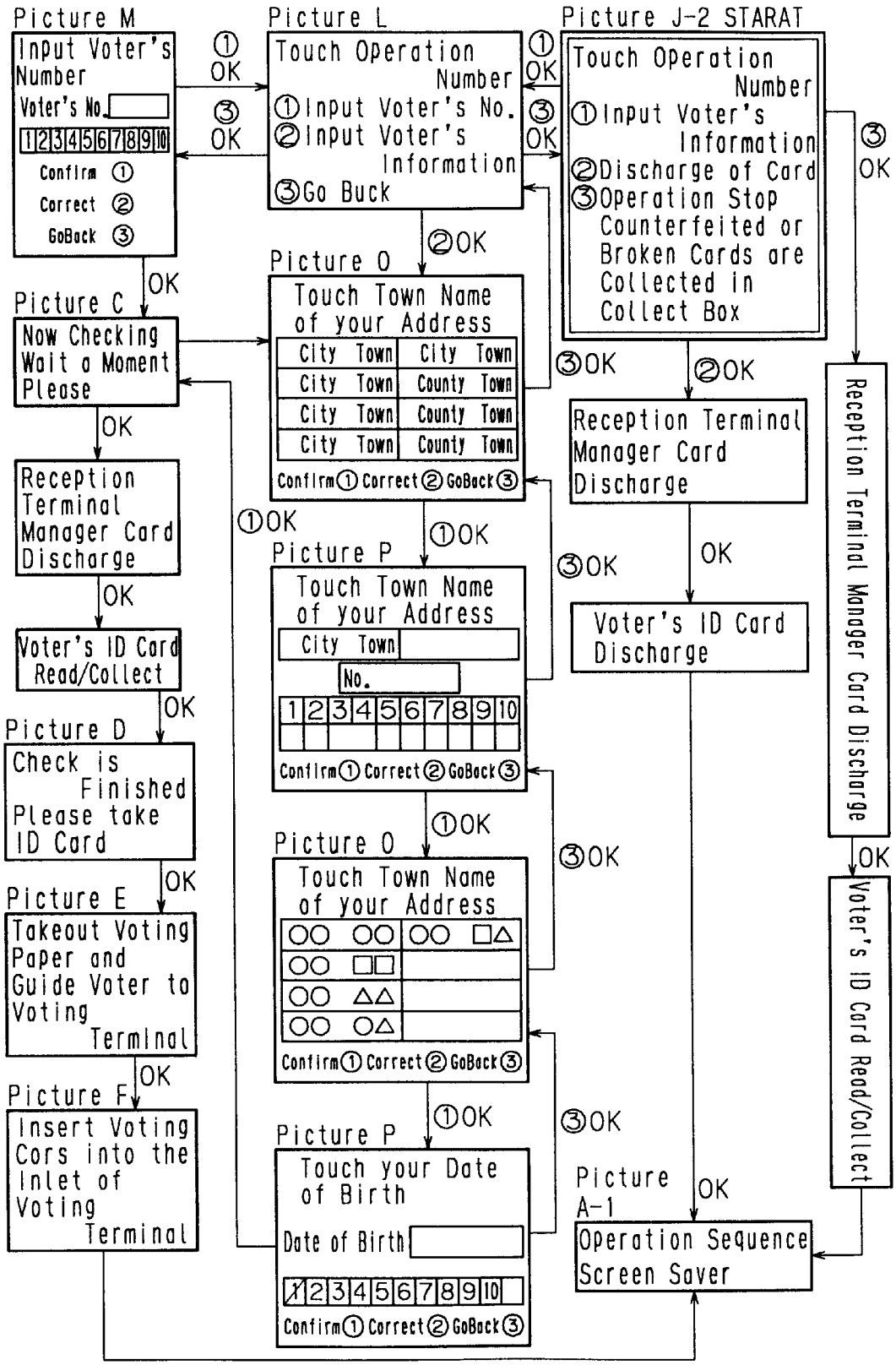
FIG. 10 is a diagram showing guidance screens used in implementation procedure 3 of the voter identification apparatus in FIG. 1.

With respect to the counterfeit, on the other hand, a screen with a message "Please input operation number." is displayed after the picture H turned into the picture I. Thereafter, a screen (Picture J-2) for urging to input any one of the following items; (1) to input voter's information, (2) to discharge the card, (3) to stop further operation, is displayed. If item (1) is selected on the touch panel monitor 22, processing according to the flowchart shown in FIG. 10 is performed. If the item (2) or (3) is selected, the manager's card is discharged and the display resumes to the screen saver.

When there is an error requiring change of cartridge, the picture K starts with a message "Operation has stopped. Please wait a moment." After that, parts that may be causes of the error are displayed with the aid of sensors provided for the parts. With the arrangement, a message "No voting cards, Please change cartridge." (Picture K-1) is displayed, with respect to the store box 27 for the voting papers. With respect to the exchange ticket box 29, for example, a message "No exchange ticket for the ID card reissuing. Please change cartridge." (Picture K-2) is displayed. With respect to the unreadable card box 28 for example, the message "ID card store box is full. Please change the cartridge." (Picture K-3) is displayed.

If any troubles occurred in some hardware, a message "Hardware trouble occurred. Record was stored automatically. Please cut off the power." (Picture K-4) is displayed by OS. With the manager's card inserted and change of the cartridge or other necessary measures taken, the manager card is discharged and the screen saver is displayed by touching the confirmation button.

In case when picture J-2 is displayed, explanation will be made referring to flowchart shown in FIG. 10. When item (1) is selected to input, a message "Push an operation number." is displayed and a picture for selectively inputting (Picture L) among the following three items is displayed; (1) Input a voter s number, (2) Input voter's information, (3) Go back. Here, when item (1) is selected to input, a message "Please input a voter's number." is displayed and then a picture for urging to input the voter's number indicating figures "1" to "0" is displayed. By touching these figures on the touch panel monitor 22, figures appears in a column for the voter's number. Touching the confirmation button, the display turns into the following confirmation mode. That is, a picture with a message "Now confirming. Please wait a moment." (Picture C) appears, the manager's card is discharged and the ID card is collected. Then a message "Identification has finished. Please take ID card. Please keep it not to lose." (Picture D) is displayed and voting card is issued. Then the Pictures E and F described above are displayed to permit the voter to operate the voting terminal.

If the "Go back" button is touched in Picture M, display goes back to Picture L and Picture J-2.

On the other hand, if item (2) is selected in Picture L, pictures O, P, Q and R for inputting an address, a name and a date of birth are displayed for inputting the voter's information. Here, if the required data is input through the touch panel monitor 22, the display on the monitor 22 turns into the Picture C. The display then turns into the confirmation mode as described with respect to the input of voter's number. Having completed the checking following to the flowchart shown in FIG. 3 and FIG. 4, voting is permitted using the voting terminal (not illustrated).

If item (2), "Discharge of card", is selected in Picture J-2, the manager's card and ID card are discharged and display goes back to the screen saver (Picture A-1). If item (3), "Stop of operation", is selected, the manager's card is discharged, ID card is collected and display goes back to the screen saver (Picture A-1).

Figure 11:
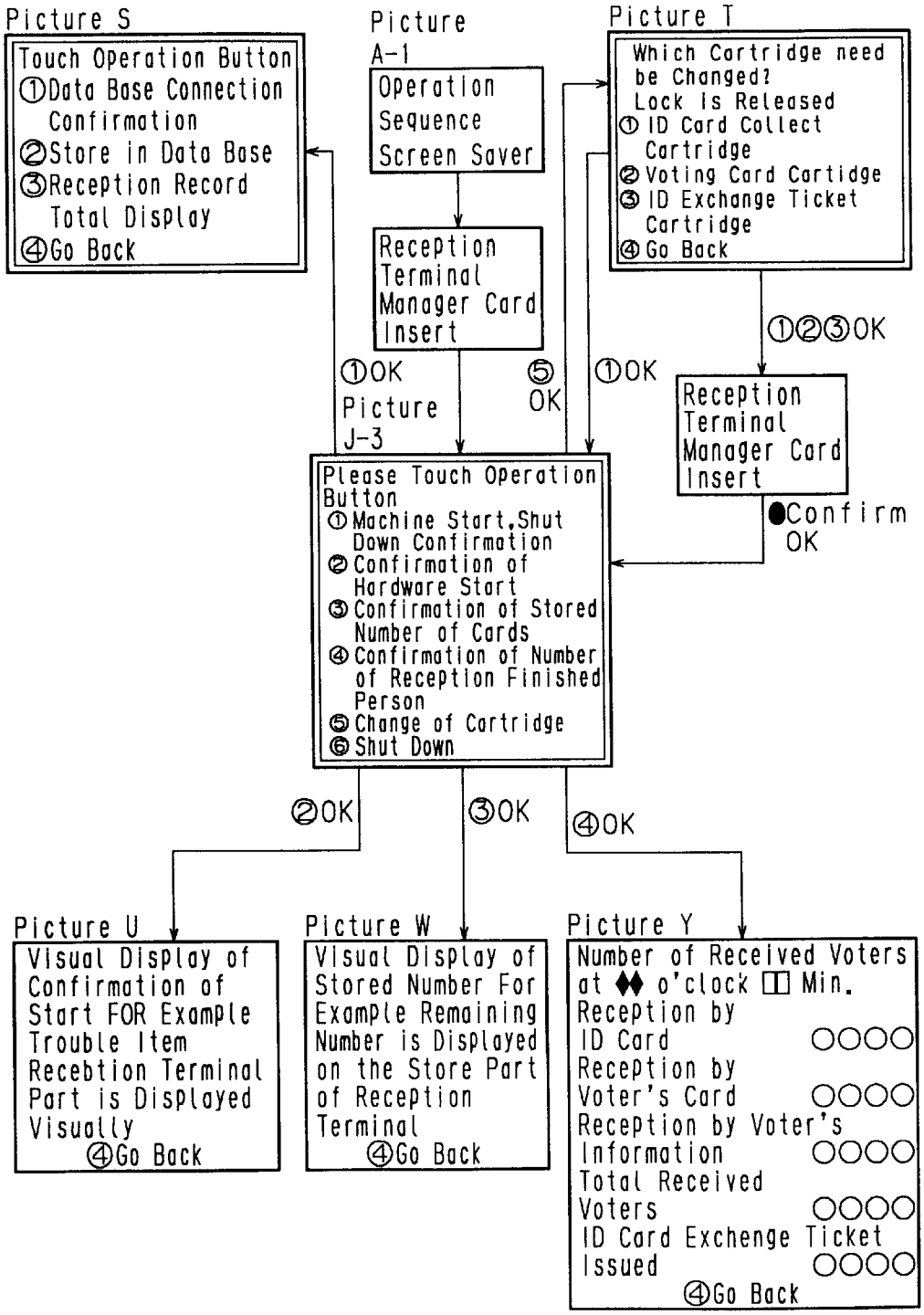
FIG. 11 is a diagram showing guidance screens used in implementation procedure 4 of the voter identification apparatus in FIG. 1.

FIG. 11 shows a flowchart for operating a sequence in which the reception terminal manager performs maintenance of the voter identification terminal.

By inserting the manager's card while the screen saver is displayed (Picture A-1), Picture J-3 appears. Picture J-3 displays a message "Please touch operation button", which urges to selectively input one of the following items; (1) Confirmation of machine start and shut down, (2) Confirmation of hardware start, (3) Confirmation of the number of cards stored, (4) Confirmation of the number of voters whose reception have completed, (5) Change of the cartridge (6) Shut down. If item (1) "Confirmation of machine start and shut down" is selected, a message "Please touch operation button" is displayed and thereafter a picture (Picture S) for selective input from one of the following is displayed; (1) Confirmation of connection of data base, (2) Storing in data base (3) Display of the reception record counted, (4) Shut down. By touching each of the item number, each corresponding operation is performed. If item (2) "Confirmation of hardware start." is selected, a picture U is displayed, which displays parts of the terminal having a trouble, for example. If item (3) "Confirmation of the number of cards stored." is selected, a picture W is displayed, which displays, for example, the remaining number is displayed on the display parts of the voter confirm terminal.

If item (4) "Confirmation of the number of voters whose reception have completed." is selected, a picture Y is displayed indicating under the title of "The number of voters received at the present time", the number of the voters received by using the ID card, the number of the voters received by using the voter's code, the number of the voters received by using the voters information, the total number of voters received and the number of the exchange cards issued. Finally, if item (5) "Change of cartridge" is selected, a picture T is displayed with a message "Which cartridge need be change? Lock is released." is displayed. The following items; (1) ID card collect cartridge, (2) voting card cartridge and (3) Exchange ticket cartridge are displayed for selection Upon selection of one of the three items, the corresponding operation is carried out and the proceeding is completed.

Although only a CD-ROM is shown as a recording media for storing a voter's database, those media that have a relatively large capacitor and capable of additional recording such as a hard disc or a MO may be used in the embodiment of the present invention. According to the present invention, as described above, the conventional voter's data is digitized to form a database together with the portrait photograph of the voter so that the voting by another person may be avoided by the confirmation with man's eyes. The ID card is issued to the voter in a form like a driver's license and is used as an entrance ticket to the polling station. In the polling station, the voter's information recorded on the ID card is read out with portrait photograph, and the result of the reading is compared with the database to identify the voter automatically. With the result of the identification, a voting paper or voting card is issued. With the configuration, the reception job for voting is automated with high efficiency.

As is described in detail, the present invention provides a method and apparatus for digitizing the voter's information including portrait photograph and for issuing the ID card that is used as an entrance ticket to the polling station, so that only lawful voters can receive voting cards by comparing the ID card with the voters' data base. Thus, the reception process of the polling station is automated and a rapid and highly reliable reception job is achieved. Since the conventional job for manually referring to the voters' list and for handing the voting paper to voters are not needed. Therefore, reception job is simplified and automated so that the load of receptionists is decreased. Besides, it is possible to prevent illegal voting since the voting paper is not issued for unauthentic voters.

What is claimed is:

1. A method for identifying a voter comprising the steps of:

storing personal data of voters including portrait data extracted from a voter list into a voter data base;

recording at least a part of the personal data and the portrait data on an entrance ticket to a polling station and delivering the entrance ticket to each voter;

reading the personal data recorded on the entrance ticket by a terminal device having a touch panel;

comparing the personal data read out from said voter data base through on-line or off-line into the terminal device with the personal data read out from the entrance ticket;

displaying the portrait data read out from the voter data base on the touch panel of the terminal device when both the personal data compared are identical;

confirming authenticity by visually comparing the portrait data displayed on the touch panel with a face of the voter; and delivering a voting card to the voter based on a result of the confirmation of an authentic voter.

2. A method for identifying a voter comprising the steps of:

storing personal data of voters including portrait data and voting history data in a given election in a voter data base;

distributing to each voter an entrance ticket to a polling station on which at least a part of the personal data including the voting history data of the voter is recorded and on which the portrait data of the voter is printed;

reading the personal data including the voting history data of the voter recorded on the entrance ticket using a terminal device having a touch panel;

displaying on the touch panel an indication that the voter is going to double vote and stopping further processing when the voting history data read out indicates that the voter is going to double vote;

comparing the personal data read out from said voter data base, based on the personal data read from the entrance ticket, through on-line or off-line into the terminal device with the personal data read out from the entrance ticket when the voting history data indicates that the voter is not double voting;

stopping the further processing when both the personal data compared are not identical;

displaying the portrait data read out from the voter data base on the touch panel of the terminal device when both the personal data compared are identical;

confirming authenticity by visually comparing the portrait data displayed on the touch panel with a face of the voter and by checking the voting history data;

inputting information about the authenticity by a selective input means displayed on the touch panel;

stopping further processing when the information shows that the voter is not authentic;

additionally recording the voting history of the given election in the entrance ticket and in the voter data base when the information shows that the voter is authentic; and delivering a voting card to the voter who is confirmed to be authentic.

3. The method for identifying a voter claimed in claim 1, characterized in that formerly present voter's information including a full name is recorded in a code form in the voter list and the portrait data is recorded in picture form.

4. The method for identifying a voter claimed in claim 1 or 2, characterized in that a result of the confirmation is transmitted through the touch panel display or through voice.

5. An apparatus for identifying a voter comprising:

a voter data base for storing personal data including portrait photograph data for a plurality of voters;

an entrance ticket to a polling station that is distributed to each of the voters on which the personal data except for the portrait photograph data is recorded and on which the portrait photograph data is displayed; and a terminal device having a touch panel for reading the personal data of voters recorded on the entrance ticket;

said terminal device further comprising;

means for reading out the corresponding personal data from the voter data base and the personal data read from the entrance ticket and for comparing both the personal data, means for displaying the portrait photograph data on the touch panel together with the personal data read out from the voter data base by the terminal device when both the personal data are identical, and means for selectively inputting information about authenticity of a voter using an input means displayed on the touch panel.

6. An apparatus for identifying a voter comprising:

a voter database for storing personal data including portrait photograph data and voting history data in a given election for a plurality of voters;

an entrance ticket to a polling station that is distributed to each of the voters on which the personal data except for the portrait photograph data is recorded and on which the portrait photograph data is printed and displayed; and a terminal device having a touch panel for reading the personal data of a voter recorded on the entrance ticket;

said terminal device further comprising;

means for displaying on the touch panel an indication that the voter is going to double vote and stopping further processing when the voting history data read out indicates that the voter is going to double vote, means for comparing the personal data read out from said voter data base with the personal data read out from the entrance ticket, means for displaying the portrait photograph data on the touch panel together with the personal data read out from the voter data base by the terminal device when both the personal data are identical, means for confirming whether there is a voting history in the given election based on the voting history data included in the personal data recorded in the entrance ticket or the voter data base, means for selectively inputting information about authenticity of the voter using an input means displayed on the touch panel when the authenticity of the voter is confirmed by the confirming means and the personal data including the portrait photograph data, means for additionally recording the voting history in the given election as the voting history data in the entrance ticket and in the voter data base according to the information from the input means, and means for delivering a voting card for the voter by the information from the input means.

7. The apparatus for identifying a voter claimed in claim 5 or 6, characterized in that the entrance ticket is an IC card and the means for reading and recording is an IC card reader and writer for reading a voter's name, birth date, gender, and address recorded on the IC card and for writing an ID number of the terminal device and a reception time.

8. The apparatus for identifying a voter claimed in claim 5 or 6, characterized in that the means for reading and recording includes an optical character reading apparatus which optically reads letters indicating a voter's name or a voter's ID number recorded on the entrance ticket.

9. The apparatus for identifying a voter claimed in claim 5 or 6, characterized in that the means for reading and recording includes a bar code reading apparatus for optically reading bar code indicating a voter's name or a voter's ID number recorded on the entrance ticket.

10. The apparatus for identifying a voter claimed in claim 5 or 6, characterized in that the means for reading and recording includes a magnetic reading apparatus for magnetically reading a voter's name or a voter's ID number recorded magnetically on the entrance ticket.

11. The apparatus for identifying a voter claimed in claim 5 or 6, characterized in that the comparing means comprises means for finding a voter's name which coincides with a result of reading the entrance ticket by retrieving the voter data base, means for reading the personal data corresponding to the voter's name found and means for comparing the personal data thus read out with the personal data read out from the entrance ticket.

12. The apparatus for identifying a voter claimed in claim 5 or 6, characterized in that the touch panel of the terminal device is a liquid crystal display device.

13. The apparatus for identifying a voter claimed in claim 5 or 6, characterized in that the voting card is a voting paper on which a candidate's name is written.

14. The apparatus for identifying a voter claimed in claim 5 or 6, characterized in that the voting card is a token for operating a voting terminal device into which the voter inputs data indicating a candidate's name.

15. The apparatus for identifying a voter claimed in claim 5 or 6, characterized in that a result of confirming the authenticity of the voter is transmitted through the touch panel display or by voice.

16. An apparatus for identifying a voter comprising:

a box type case having an inlet for inserting an entrance ticket to a polling station provided on a front of the case and an outlet for delivering a voting card provided on the front of the case;

a touch panel display device provided on the front of the case;

a card reading device stored inside the case for reading the personal data recorded on the entrance ticket inserted in the inlet and for recording additional data on the entrance ticket;

a voter data memory for memorizing personal data including portrait photograph data for a plurality of voters;

a display means provided in the case for comparing data read out from the card reading device with the corresponding personal data read from the memory and for displaying the portrait photograph data together with the personal data on the touch panel display device when both the personal data compared are identical;

an input means provided in the touch panel display device for inputting information indicating that the voter is authentic when the voter is confirmed to be authentic by visually comparing the portrait photograph data displayed with a face of the voter;

means provided in the case for delivering a voting card according to the information provided by the input means and for discharging the voting card from the outlet when the voter is confirmed to be authentic.

17. An apparatus for identifying a voter comprising:

a box type case having an inlet for inserting an entrance ticket to a polling station provided on a front of the case and an outlet for delivering a voting card provided in the front of the case;

a touch panel display device provided in the front of this case on which an information input button is displayed;

a card reading and writing device provided in the case for reading the personal data recorded on the entrance ticket inserted in the inlet and for recording additional data on the entrance ticket;

a voter data memory for memorizing personal data including portrait photograph data and voting history data in a given election for a plurality of voters;

means stored in the case for discharging the voting card from the outlet when the voter is confirmed to be authentic; and a central processing unit provided in the case, the central processing unit further comprising;

means for comparing the data read out by the card reading and writing device with corresponding personal data read out from a voter data base, means for displaying the portrait photograph data on the touch panel together with the personal data read out from the voter data base when both the personal data compared are identical, means for confirming whether there is a voting history in the given election based on the voting history data included in the personal data recorded in the entrance ticket or the voter data base, means for selectively inputting information on authenticity of the voter using an input means displayed on the touch panel when the authenticity of the voter is confirmed by the confirming means and the personal data including the portrait photograph data, means for additionally recording the voting history in the given election as the voting history date in the entrance ticket and in the voter data base according to the information from the input means, and means for operating and controlling the voting card discharging means to discharge a voting card from the outlet when the voter is confirmed to be authentic.

18. The apparatus for identifying a voter claimed in claim 16, characterized in that the voter data memory temporally stores data transmitted from an on-line voter data base or stores data reproduced from the voter data base.

19. The apparatus for identifying a voter claimed in claim 16, characterized in that the voting card delivering means further comprises means for initializing the voting card before discharging the voting card from the outlet.

20. The apparatus for identifying a voter claimed in claim 16, characterized in that the voting card delivering means further comprises means for recording a unique number given to the apparatus for identifying a voter and a series number on the voting card when delivering the card.

21. The apparatus for identifying a voter claimed in claim 16 or 17, characterized in that the voting card is composed of an IC card.

22. The apparatus for identifying a voter claimed in claim 16 or 17, characterized in that the case is provided with a card stacker in which voting cards are stacked, the voting cards stacked in the card stacker are taken out one by one according to the information on the authenticity, and prescribed data is written on the voting card which is then discharged from the outlet.

23. The apparatus for identifying a voter claimed in claim 16 or 17, characterized in that a card stacker is made in a cartridge structure which is easy to insert and draw out of the case and that the cartridge is opened or closed by a key.

24. The apparatus for identifying a voter claimed in claim 16 or 17, characterized in that the touch panel display device displays a picture explaining a flow of an issuing procedure of the voting card as a screen saver when the voter identifying apparatus is not in use and a series of guidance pictures including voice outputs corresponding to each step of the issuing procedure of the voting card are displayed when the voter identifying apparatus is in use.

* * * * *